US012295478B2

(12) United States Patent
Lee

(10) Patent No.: US 12,295,478 B2
(45) Date of Patent: May 13, 2025

(54) ROTATING DISCHARGE TYPE COSMETIC CONTAINER

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 0 days.

(21) Appl. No.: 18/732,015

(22) Filed: Jun. 3, 2024

(65) Prior Publication Data

US 2024/0407533 A1 Dec. 12, 2024

(30) Foreign Application Priority Data

Jun. 7, 2023 (KR) ..... 10-2023-0072911

(51) Int. Cl.
*A45D 40/06* (2006.01)

(52) U.S. Cl.
CPC ..... *A45D 40/06* (2013.01)

(58) Field of Classification Search
CPC ..... A45D 33/14; A45D 40/04; A45D 40/06; A45D 2040/0043; A45D 2040/005
See application file for complete search history.

(56) References Cited

U.S. PATENT DOCUMENTS

| | | | | |
|---|---|---|---|---|
| 3,531,212 | A * | 9/1970 | Landen | A45D 40/06 401/75 |
| 5,605,408 | A * | 2/1997 | Su | A45D 40/06 401/86 |
| 10,869,535 | B2 * | 12/2020 | Lee | A45D 40/06 |
| 11,033,091 | B2 * | 6/2021 | Wiesenthal | A45D 40/16 |
| 11,812,839 | B2 * | 11/2023 | Thulin | A45D 40/06 |
| 11,832,703 | B2 * | 12/2023 | Lee | A45D 33/14 |

FOREIGN PATENT DOCUMENTS

| | | |
|---|---|---|
| KR | 10-2188196 B1 | 12/2020 |
| KR | 10-2279516 B1 | 7/2021 |

* cited by examiner

*Primary Examiner* — David P Angwin
*Assistant Examiner* — Bradley S Oliver
(74) *Attorney, Agent, or Firm* — Heedong Chae; Lucem, PC

(57) ABSTRACT

Disclosed is a rotating discharge type cosmetic container including: an outer case formed therein with a first fixed connection portion; a rotation operating member rotatably coupled to an inside of the outer case and formed therein with a first rotation connecting portion; an inner case detachably coupled to the rotation operating member to accommodate cosmetic contents therein; a rotating member rotatably coupled to the inner case, formed therein with a second rotation connecting portion, and having one surface formed with a discharge port; an operating member connected to the rotation operating member and rotated together with the rotation operating member; a lifting member screw-coupled with the operating member, moved in a straight line within the inner case, and formed therein with a second fixed connection portion; and a piston for moving the cosmetic contents while being moved up and down together with the lifting member.

10 Claims, 8 Drawing Sheets

ROTATING DISCHARGE TYPE COSMETIC CONTAINER

BACKGROUND

1. Field

One aspect of the present disclosure relates to a cosmetic container, and more particularly, to a rotating discharge type cosmetic container to conveniently use cosmetic contents while discharging the cosmetic contents through rotating operation.

2. Description of Related Art

In general, women use various cosmetics to make up their appearances more beautiful. Among the cosmetics, color cosmetics are used for the purpose of making the skin beautiful by changing the appearance beautifully.

The color cosmetics are divided into base makeup cosmetics used for uniformizing the skin color and covering the defects, and point makeup cosmetics for partially enhancing the three-dimensional feeling such as lips, eyes, nails. The base makeup cosmetics include makeup base, foundation, powder and the like, and the point makeup cosmetics include lipstick, eyeliner, mascara and the like.

The foundation refers to a cosmetic product used to naturally cover spots or blemishes on the skin exposed to the outside, such as the face, or to express clean and bright skin or clear and soft skin. When used for makeup, the foundation is spread evenly on the skin without clumping by using a cosmetic puff.

In general, the foundation is contained and stored in a wide and flat cosmetic container, and a puff is placed inside the cosmetic container together. A user opens a lid of the cosmetic container, holds the puff accommodated on an upper part of a lid of an inner container, opens the lid of the inner container, dips foundation cosmetic contents using the puff and then applies the contents onto the skin for use.

However, since the conventional cosmetic container is required to be used with the container lid opened, cosmetic contents may be completely exposed to the air and thus foreign substances may be easily introduced, and since a puff having come into contact with the skin in use repeatedly comes into contact with the cosmetic contents, the cosmetic contents may be contaminated by bacteria, viruses, fungi and the like, and accordingly skin problems may be caused or a period of use may be shortened. In addition, since the conventional cosmetic container is configured such that the cosmetic contents are dipped and used by using a cosmetic tool such as a puff or using a finger, the used amount of cosmetic contents may not be consistently controlled, thereby wasting the cosmetic contents, and causing difficulty in use.

Thus, cosmetic containers have been developed to minimize deterioration and contamination during use of cosmetics, enable convenience for use, and consistently control the discharge amount of cosmetic contents.

As the related art having the above structure, cosmetic containers are disclosed in Korean Patent Registration No. 10-2188196 (hereinafter referred to as 'Related Art 1') and Korean Patent Registration No. 10-2279516 (hereinafter referred to as 'Related Art 2') and will be described as follows.

Related Art 1 includes an inner case having an inner space, a rotation bezel rotatably coupled to an upper part of the inner case and having a discharge hole, a rotating member located in the inner space and coupled to the rotation bezel so as to be integrally rotated with the rotation bezel, and a piston located in the inner space and coupled to the rotating member to ascend and descend in conjunction with the rotation of the rotating member.

Related Art 2 includes a body having an inner space, a dial rotatably coupled to an upper part of the body and including a discharge hole through which contents are discharged and a cutter for pulverizing the contents, a screw located below the dial in the inner space so as to be integrally rotated with the dial, and a piston screw-coupled around the screw to ascend and descend inside the inner space by the rotation of the screw.

However, since Related Arts 1 and 2 do not have a separate inner case refill structure, the entire cosmetic container is required to be discarded after contents stored in the inner case are entirely used, and accordingly resources may be wasted and the environment may be polluted due to the discarded container.

Accordingly, it is necessary to develop a stick type cosmetic container for allowing some components of the cosmetic container to be replaceable so as to relieve the economic burden of a user and reduce resource waste and environmental pollution, and allowing replacing work of some components to proceed conveniently.

(Patent Document 001) Korean Patent Registration (Published on Dec. 9, 2020)

(Patent Document 002) Korean Patent Registration (Published on Jul. 21, 2021)

SUMMARY

In order to solve the above conventional problems, one aspect of the present disclosure provides a rotating discharge type cosmetic container in which an inner case is detachably coupled to an inside of an outer case, and a rotating member is engaged with the inside of the outer case along detached direction of the inner case, so that the rotating member, the inner case, and components connected thereto can be conveniently separated and replaced with respect to the outer case.

In order to achieve the above-mentioned objects, one aspect of the present disclosure provides a rotating discharge type cosmetic container including: an outer case formed therein with a first fixed connection portion; a rotation operating member rotatably coupled to an inside of the outer case and formed therein with a first rotation connecting portion; an inner case detachably coupled to the rotation operating member to accommodate cosmetic contents therein; a rotating member rotatably coupled to the inner case, formed therein with a second rotation connecting portion, and having one surface formed with a discharge port; an operating member connected to the rotation operating member and rotated together with the rotation operating member; a lifting member screw-coupled with the operating member, moved in a straight line within the inner case, and formed therein with a second fixed connection portion; and a piston for moving the cosmetic contents while being moved up and down together with the lifting member.

In addition, an over-cap for opening and closing the rotating member may be detachably coupled to the outer case.

In addition, the first fixed connection portion of the outer case and the second fixed connection portion of the lifting member may extend in a detached direction of the inner case so as to be engaged with each other to limit rotation of the lifting member with respect to the outer case.

In addition, the first fixed connection portion and the second fixed connection portion may alternately protrude from facing surfaces between the outer case and the lifting member.

In addition, the rotation operating member and the inner case may be formed thereon with a first detachable portion and a second detachable portion, respectively, so as to be detachably coupled to each other.

In addition, the first rotation connecting portion of the rotation operating member and the second rotation connecting portion of the rotating member may extend in a detached direction of the inner case so as to be engaged with each other to transmit a rotation movement of the rotating member to the rotation operating member.

In addition, the first rotation connecting portion and the second rotation connecting portion may alternately extend by a predetermined section on facing ends between the rotation operating member and the rotating member.

In addition, the first and second rotation connecting portions may have ends formed thereon with first and second guide inclined surfaces, respectively.

In addition, the rotating member may be provided with a cutting blade for cutting a surface of the cosmetic contents.

In addition, in a refilling process of fastening the inner case and the rotation operating member with each other, the first rotation connecting portion of the rotation operating member may be engaged and fitted with the second rotation connecting portion of the rotating member, and simultaneously the first fixed connection portion of the outer case may be engaged and fitted with the second fixed connection portion of the lifting member.

According to the embodiment of the present disclosure, the cosmetic contents may be discharged to the outside by rotating the rotating member, and the discharge amount of the cosmetic contents may be easily controlled according to the rotation angle of the rotating member, so that convenience of use can be improved.

According to the embodiment of the present disclosure, the rotating member may be pulled or the inner case may be inserted with respect to the outer case, so that the rotating member, the inner case, and the components connected thereto can be conveniently separated and replaced at once.

According to the embodiment of the present disclosure, the inner case in which the cosmetic contents are entirely exhausted can be refilled from the outer case, and the above refill structure can relieve the user's economic burdens and reduce resource wastes.

DETAILED DESCRIPTION

Figure 1:
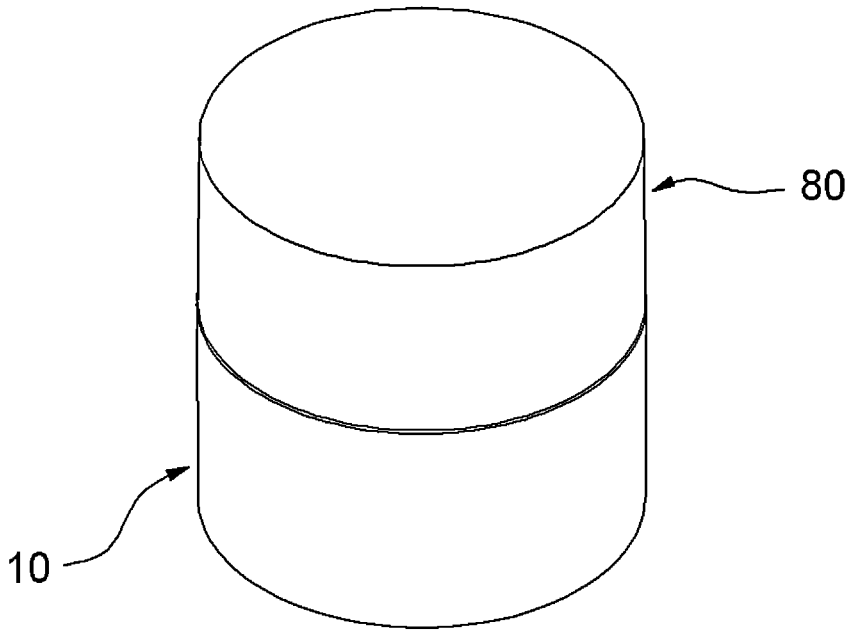
FIG. 1 is a perspective view of a cosmetic container according to one embodiment of the present disclosure.

Hereinafter, the detailed descriptions of the present disclosure are embodiments for carrying out the present disclosure, and the corresponding embodiment refers to the accompanying drawings as an example. The embodiments will be described in detail to enable those skilled in the art to carry out the present disclosure. It is apparent to be understood that the various embodiments of the present disclosure may be different from each other but do not need to be mutually exclusive. For example, the particular shapes, structures, and features described herein may be embodied in other embodiments without departing from the idea and scope of the present disclosure in connection with an embodiment. In addition, it will be understood that the location or arrangement of an individual element within each disclosed embodiment may be modified without departing from the idea and scope of the present disclosure.

Accordingly, the detailed description set forth below is not intended to be taken in a limiting sense, and the scope of the present disclosure is limited only by the appended claims, along with the full scope of equivalents to which the claims are entitled, if properly described. Similar reference numerals in the drawings refer to the same or similar function throughout several aspects.

General term which is widely used recently has been selected in the present disclosure in consideration of the function according to the present disclosure as possible, but this may vary depending on intention of those skilled in the art, precedents, emergence of new technology or the like. In a certain case, the term may be arbitrarily selected by the applicant, and in this case, the meaning thereof will be described in detail in the relevant description of the present disclosure. Therefore, the term used in the present disclosure will be defined based on the meaning of the term and contents throughout the present disclosure, not simply on the name of the term.

In the present disclosure, when one component "includes" some elements, it does not exclude other elements, but may further include the other elements, unless particularly stated otherwise. Hereinafter, a rotating discharge type cosmetic container according to the embodiments of the present disclosure will be described in detail with reference to the accompanying drawings.

Figure 2:
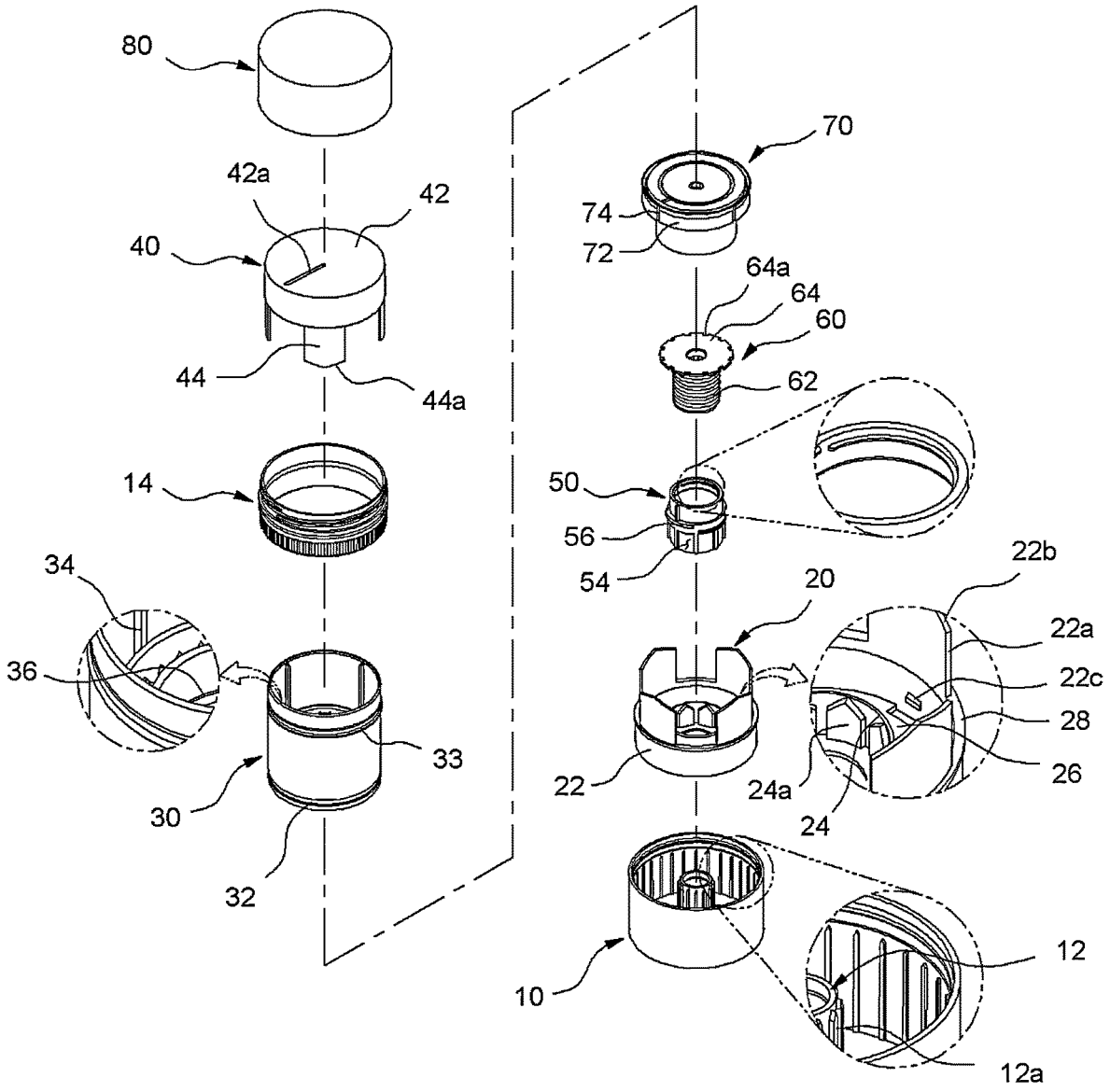
FIG. 2 is an exploded perspective view of the cosmetic container according to the one embodiment of the present disclosure when viewed from above.
Figure 3:
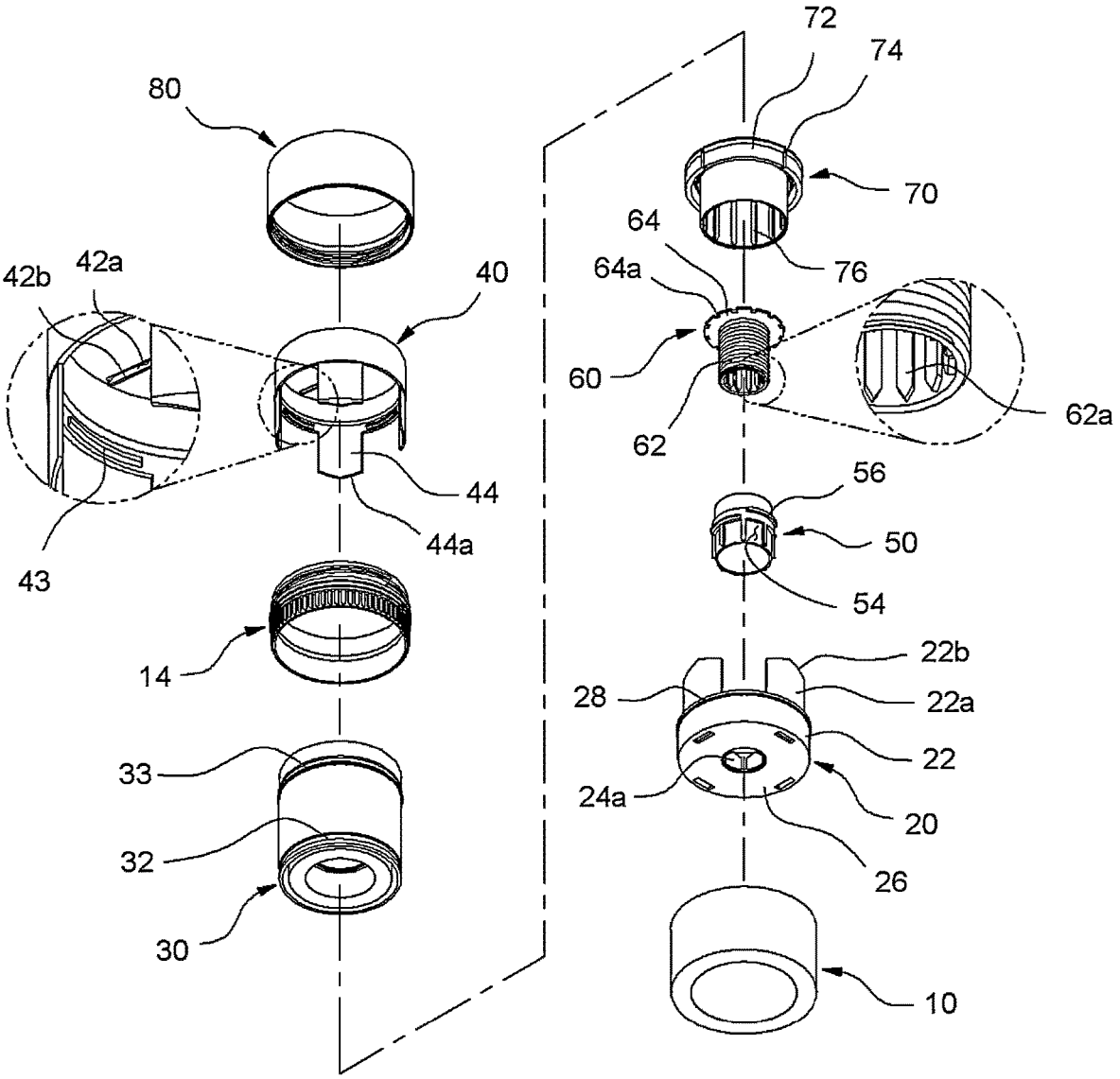
FIG. 3 is an exploded perspective view of the cosmetic container according to the one embodiment of the present disclosure when viewed from below.
Figure 4:
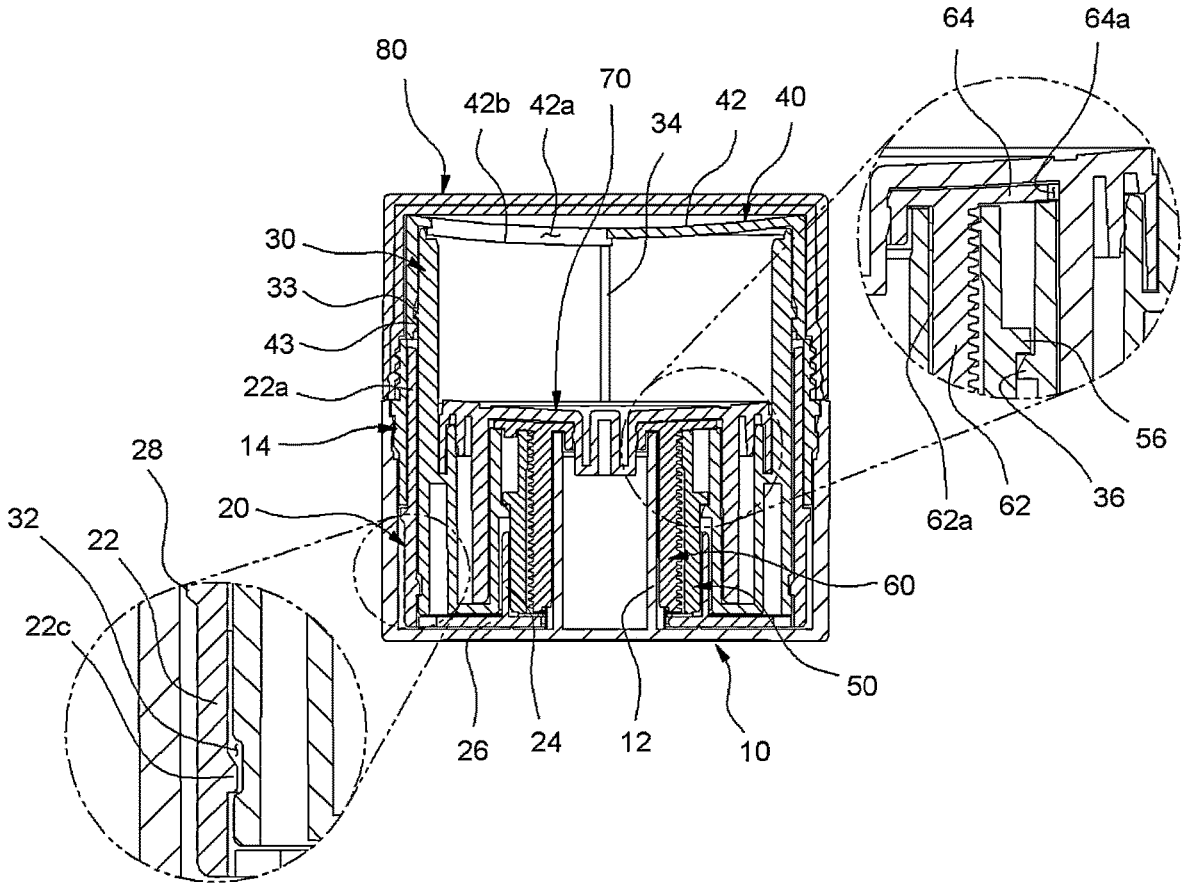
FIG. 4 is a sectional view of the cosmetic container according to the one embodiment of the present disclosure.

FIG. 1 is a perspective view of a cosmetic container according to one embodiment of the present disclosure. FIG. 2 is an exploded perspective view of the cosmetic container according to the one embodiment of the present disclosure when viewed from above. FIG. 3 is an exploded perspective view of the cosmetic container according to the one embodiment of the present disclosure when viewed from below. FIG. 4 is a sectional view of the cosmetic container according to the one embodiment of the present disclosure.

As shown in the drawings, the rotating discharge type cosmetic container according to the embodiments of the present disclosure is configured to include an outer case 10, a rotation operating member 20, an inner case 30, a rotating member 40, an operating member 50, a lifting member 60, and a piston 70.

Hereinafter, the rotating discharge type cosmetic container according to the embodiments of the present disclosure will be described separately for each component as follows.

The outer case 10 has a hard cylindrical shape having one side open and formed therein with a space of a predetermined size, in which the rotation operating member 20 and the inner case 30 are at least partially inserted and coupled into the inner space. The outer case 10 is not limited to the hard cylindrical shape, and may be formed in various shapes or materials in consideration of types, usability, design factors and the like of cosmetic contents stored therein.

As shown in FIGS. 2 and 3, a coupling extension portion 12 may be formed in an inner center of the outer case 10. The coupling extension portion 12 extends from a bottom surface of the outer case 10 by a predetermined height, and is coupled to the lifting member 60 while an outer side thereof being surrounded. The outer case 10 and the lifting member 60 remain fixed together when the rotating member 40 is rotated, in which the coupling extension portion 12 may be formed on an outer circumference thereof with a first fixed connection portion 12*a* to be coupled to the lifting member 60. The first fixed connection portion 12*a* may protrude along the outer circumference of the coupling extension portion 12 while being spaced apart at regular intervals, and the first fixed connection portion 12*a* may be sharper toward an end thereof to smoothly fit the outer case 10 to the lifting member 60.

Meanwhile, a fixture 14 may be coupled inside the outer case 10. The fixture 14 has a ring shape with both sides open to stably assemble and fix the inner case 30 so as to be prevented from being separated from the outer case 10, in which at least a part of the fixture 14 is fixedly coupled inside the outer case 10, and the remaining portion is exposed to the open one side of the outer case 10.

The outer case 10 may be further provided at the one side thereof with an over-cap 80 for opening or closing the rotating member 40. The over-cap 80 is detachably fastened to the outer case 10 or the fixture 14 while covering the rotating member 40, separated from the outer case 10 or the fixture 14 to expose the rotating member 40 to the outside when being used, and coupled to the outer case 10 or the fixture 14 to protect the rotating member 40 when being stored or carried. The rotating discharge type cosmetic container according to one embodiment of the present disclosure shows that threads are formed on the fixture 14 and the over-cap 80 and screw-coupled together. However, the present disclosure is not limited thereto, and there may be various coupling structures, such as coupling using protrusions and grooves, forced fitting coupling, and undercut coupling, within the range in which the over-cap 80 is allowed to be easily attached to and detached from the fixture 14.

The rotation operating member 20 is rotatably coupled to the inside of the outer case 10 to rotate the operating member 50 while being rotated together with the rotating member 40. The rotation operating member 20 serves to transmit a rotational movement of the rotating member 40 to the operating member 50, in which the inner case 30 may be inserted into an inner space of the rotation operating member 20, and the operating member 50 may be fixedly coupled to a center of the rotation operating member 20.

As shown in the partially enlarged view of FIG. 2, the rotation operating member 20 may include an outer wall 22, an inner wall 24 spaced at regular intervals inward from the outer wall 22, and a connection bottom plate 26 for connecting the outer wall 22 and the inner wall 24 to each other. At least a part of the inner case 30 is inserted into a space between the outer wall 22 and the inner wall 24, the operating member 50, the lifting member 60 and the coupling extension portion 12 of the outer case 10 are inserted into the inner wall 24, and the connection bottom plate 26 is seated on a bottom surface of the outer case 10.

The rotation operating member 20 is rotated together with the rotating member 40 when the rotating member 40 is rotated, in which a first rotation connecting portion 22*a* may be formed at an end of the outer wall 22 of the rotation operating member 20 so as to be coupled to the rotating member 40. The first rotation connecting portion 22*a* may extend toward the rotating member 40 while being spaced apart at regular intervals along the circumference of the end of the outer wall 22, and at least one first guide inclined surface 22*b* may be formed at an end of the first rotation connecting portion 22*a* to smoothly fit the rotation operating member 20 to the rotating member 40.

In addition, a first detachable portion 22*c* may be formed on the outer wall 22 of the rotation operating member 20 so as to be detachably coupled to a second detachable portion 32 of the inner case 30. The first detachable portion 22*c* may protrude partially or continuously along an inner circumference of the outer wall 22 of the rotation operating member 20.

At least one fitting protrusion 24*a* may be formed on an inner circumference of the inner wall 24 of the rotation operating member 20 and coupled to the operating member 50, and accordingly, the operating member 50 may be rotated together with the rotation operating member 20. The fitting protrusion 24*a* may be formed to protrude at regular intervals along the inner circumference of the inner wall 24.

Meanwhile, a locking protrusion 28 may protrude outward from an outer circumference of the rotation operating member 20, and as shown in FIG. 4, the locking protrusion 28 may be configured to be locked on an end of the fixture 14, so that the rotation operating member 20 may be prevented from being separated from the outer case 10.

The inner case 30 may be inserted into the space inside the outer case 10 and detachably coupled to the rotation operating member 20, and the cosmetic contents may be accommodated in the inner space. The inner case 30 has one open side, and the cosmetic contents are moved to the rotating member 40 through the open side. The cosmetic contents may be solid cosmetics moved in a straight line by the lifting member 60 and have an upper surface cut by the rotating member 40.

As shown in FIGS. 2 and 3, the second detachable portion 32 may be formed on an outer circumference of the inner case 30 so as to be detachably coupled to the first detachable portion 22*c*. The second detachable portion 32 may be recessed along the outer circumference of the inner case 30. The rotating discharge type cosmetic container according to one embodiment of the present disclosure shows that the first detachable portion 22*c* is formed as a protrusion and the second detachable portion 32 is formed as a groove so as to be fitted together. However, the present disclosure is not limited thereto, and both of the first detachable portion 22*c* and the second detachable portion 32 may be formed as protrusions so as to be engaged with each other. In addition, a first fastening protrusion 33 may protrude from the outer circumference of the inner case 30 so as to be rotatably coupled to the rotating member 40.

Meanwhile, a lifting guide protrusion 34 may protrude from the inner circumference of the inner case 30. The lifting guide protrusion 34 is coupled to the piston 70 to prevent the piston 70 and the cosmetic contents from being rotated with respect to the inner case 30. The lifting guide protrusion 34 may extend in the moving direction of the piston 70, and may be formed in at least one pair to be arranged to face each other. In addition, a first locking protrusion 36 may protrude from the inner circumference of the inner case 30, and at least a part of the operating member 50 may be seated on a top thereof.

The rotating member 40 is rotatably coupled to the inner case 30 while covering the open portion of the inner case 30 to discharge the cosmetic contents contained in the inner case 30 to the outside when being rotated by the user.

The rotating member 40 may be formed with a discharge surface 42 exposed to the outside to come into direct contact with a makeup tool or a finger of the user, and a discharge port 42*a* for discharging the cosmetic contents contained in the inner case 30 to the outside may be formed in the discharge surface 42. The discharge surface 42 may be recessed from an edge toward a center of the rotating member 40 to prevent the contents discharged from the inner case 30 from flowing down to a surround of the rotating member 40, and the discharge port 42*a* may be a hole having a long straight line shape extending from a center to an edge portion of the discharge surface 42. One side wall of the discharge port 42*a* may be inclined at a predetermined angle in the rotation direction of the rotating member 40 to smoothly discharge the cosmetic contents. The rotating discharge type cosmetic container according to the embodiments of the present disclosure takes an example in which the discharge port 42*a* has the long straight line extending on the discharge surface 42. However, the present disclosure is not limited thereto, and the shape, number, or position of the discharge ports 42*a* may be variously changed within a range for allowing the cosmetic contents to be easily discharged to the outside.

The rotating member 40 may be provided with a cutting blade 42*b* for cutting a surface of the cosmetic contents while being rotated. The cutting blade 42*b* refers to a protrusion having a straight line shape and extending from the center to the edge of the rotating member 40, and may be positioned at a lower part adjacent to the discharge port 42*a* to protrude toward the cosmetic contents contained in the inner case 30, and extend in the same direction as the discharge port 42*a*. The cutting blade 42*b* may become sharper toward an end thereof, and inclined in the direction of rotation of the rotating member 40 in order to smoothly grind and discharge the surface of the cosmetic contents.

In addition, a second fastening protrusion 43 may protrude from the inner circumference of the rotating member 40 so as to be rotatably engaged with the first fastening protrusion 33 of the inner case 30. Alternatively, one of the first fastening protrusion 33 and the second fastening protrusion 43 may be formed as a groove so as to be rotatably fitted with each other.

Meanwhile, the rotating member 40 is fixedly coupled to the rotation operating member 20 to rotate the rotation operating member 20, in which a second rotation connecting portion 44 may be formed at the end of the rotating member 40 so as to be fitted to the first rotation connecting portion 22*a* of the rotation operating member 20. The first rotation connecting portion 22*a* and the second rotation connecting portion 44 extend in the detached direction of the inner case 30 so as to be engaged with each other to transmit the rotation movement of the rotating member 40 to the rotation operating member 20. The first rotation connecting portion 22*a* and the second rotation connecting portion 44 may alternately extend from facing ends of the rotation operating member 20 and the rotating member 40, respectively, by a predetermined section. The second rotation connecting portion 44 may extend toward the rotation operating member 20 while being spaced at regular intervals along the circumferential end of the rotating member 40. At least one second guide inclined surface 44*a* is formed at the end of the second rotation connection part 44, and the second guide inclined surface 44*a* guides an assembly direction so that the second rotation connecting portions 44 are smoothly inserted between the first rotation connecting portions 22*a* when the rotation operating member 20 and the rotating member 40 are coupled to each other.

Meanwhile, the inner case 30 and the rotating member 40 may further include a rotation direction control structure for controlling the rotation direction of the rotating member 40. In other words, the rotation direction control structure is added to each of the inner case 30 and the rotating member 40, thereby allowing the rotating member 40 to be rotated only in the upward direction of the lifting member 60 and preventing the lifting member 60 from being rotated in the downward direction, so that convenience of use may be increased. For example, one-way rotating protrusions (not shown) for transmitting rotation in only one direction, such as a ratchet (a gear wheel that transmits rotation in only one direction and does not transmit motion in the opposite direction) gears, may be formed respectively, on the outer circumference of the inner case 30 and the inner circumference of the rotating member 40 so as to interlocked with each other.

The operating member 50 has a cylindrical shape with both sides open, and is disposed in the inner space of the outer case 10, connected to the rotation operating member 20 and rotated together to move the lifting member 60 in a straight line.

As shown in FIG. 4, the operating member 50 may be inserted into the center of the rotation operating member 20 and the inner case 30 so as to be fixedly coupled to the rotation operating member 20. At least one fitting groove 54 may be formed on the outer circumference of the operating member 50, the insertion protrusion 24*a* of the rotation operating member 20 may be inserted therebetween, and accordingly, the operating member 50 may be rotated together with the rotation operating member 20.

The fitting groove 54 may be recessed at regular intervals along the outer circumference of the operating member 50. In addition, a second locking protrusion 56 may protrude from the outer circumference of the operating member 50 and be seated on the top of the first locking protrusion 36 of the inner case 30, so as to be rotated stably without shaking with respect to the inner case 30, and separated from the rotation operating member 20 while being moved together with the inner case 30 when the inner case 30 is refilled.

The operating member 50 is coupled while surrounding the outside of the lifting member 60, in which a thread may be formed on the inner circumference of the operating member 50 and a thread is formed on the outer circumference of the lifting member 60 so as to be screw-coupled to each other.

The lifting member 60 is screw-coupled to the operating member 50 and moved in a straight line in the inner space of the inner case 30, thereby pushing up the cosmetic contents toward the open part of the inner case 30 in proportion to a rotation angle of the rotating member 40.

As shown in FIGS. 2 and 3, the lifting member 60 may include a hollow coupling portion 62 formed on an outer circumference thereof with a thread and screw-coupled to the operating member 50, and a support portion 64 extending outward from an end of the coupling portion 62 and coming into close contact with one surface of the piston 70 to push up the piston 70. The coupling portion 62 and the support portion 64 may be integrally injection-molded, or may be separately injection-molded so that the coupling portion 62 is fixedly coupled to a center of the support portion 64.

The thread may be formed on the outer circumference of the coupling portion 62 so as to be screw-coupled to the thread formed on the inner circumference of the operating member 50. The coupling portion 62 is fixedly coupled to the outer side of the coupling extension portion 12 of the outer case 10, in which a second fixed connection portion 62*a* may be formed on the inner circumference of the coupling portion 62 so as to be fitted to the first fixed connection portion 12*a* of the outer case 10. The first fixed connection portion 12*a* and the second fixed connection portion 62*a* extend along the detached direction of the inner case 30 and engage with each other to limit the rotation of the lifting member 60 with respect to the outer case 10. The first fixed connection portion 12*a* and the second fixed connection portion 62*a* may alternately protrude from facing surfaces between the outer case 10 and the lifting member 60. The second fixed connection portion 62*a* may protrude while being spaced apart at regular intervals along the inner circumference of the coupling portion 62, and the second fixed connection portion 62*a* may be sharper toward an end thereof to allow the second fixed connection portion 62*a* to easily enter the space between the first fixed connection portions 12*a*.

Meanwhile, the support portion 64 is formed with a locking groove 64*a* so as to be coupled to the piston 70, in which a plurality of locking grooves 64*a* may be spaced apart at regular intervals along the edge of the support portion 64.

The piston 70 is disposed in the inner space of the inner case 30 to move the cosmetic contents to the discharge port 42*a* while being lifted together with the lifting member 60.

A close contact portion 72 may be formed on an edge of the piston 70 to come into close contact with an inner wall of the inner case 30, a lifting guide groove 74 may be formed in the close contact portion 72 so as to be coupled to the lifting guide protrusion 34 of the inner case 30, and a locking protrusion 76 may be formed on an inside of the piston 70 so as to be coupled to the locking groove 64*a* of the lifting member 60. Accordingly, the piston 70 and the cosmetic contents may be stably moved in a straight line along the lifting guide protrusion 34 within the inner case 30 without being rotated.

As described above, in the rotating discharge type cosmetic container according to one embodiment of the present disclosure, during a refilling process of separating and fastening the inner case 30 and the rotation operating member 20, the first rotation connecting portion 22*a* of the rotation operating member 20 is engaged and fitted with the second rotation connecting portion 44 of the rotating member 40, and simultaneously the first fixed connection portion 12*a* of the outer case 10 is engaged and fitted with the second fixed connection portion 62*a* of the lifting member 60. Thus, the discharge amount of cosmetic contents may be easily controlled according to the rotation angle of the rotating member 40 so as to improve convenience of use, the inner case 30 in which the cosmetic contents are entirely exhausted may be refilled from the outer case 10 so as to reduce the user's economic burden and waste of resources, and the rotating member 40 may be pulled 10 or the inner case 30 may be inserted with respect to the outer case so as to conveniently separate and replace the rotating member 40, the inner case 30, and components connected thereto at once.

FIGS. 5 to 8 are views illustrating an operating process and a refilling process of the rotating discharge type cosmetic container according to the embodiment of the present disclosure. The using and refilling processes of the rotating discharge type cosmetic container according to the embodiment of the present disclosure will be described with reference thereto.

Figure 5:
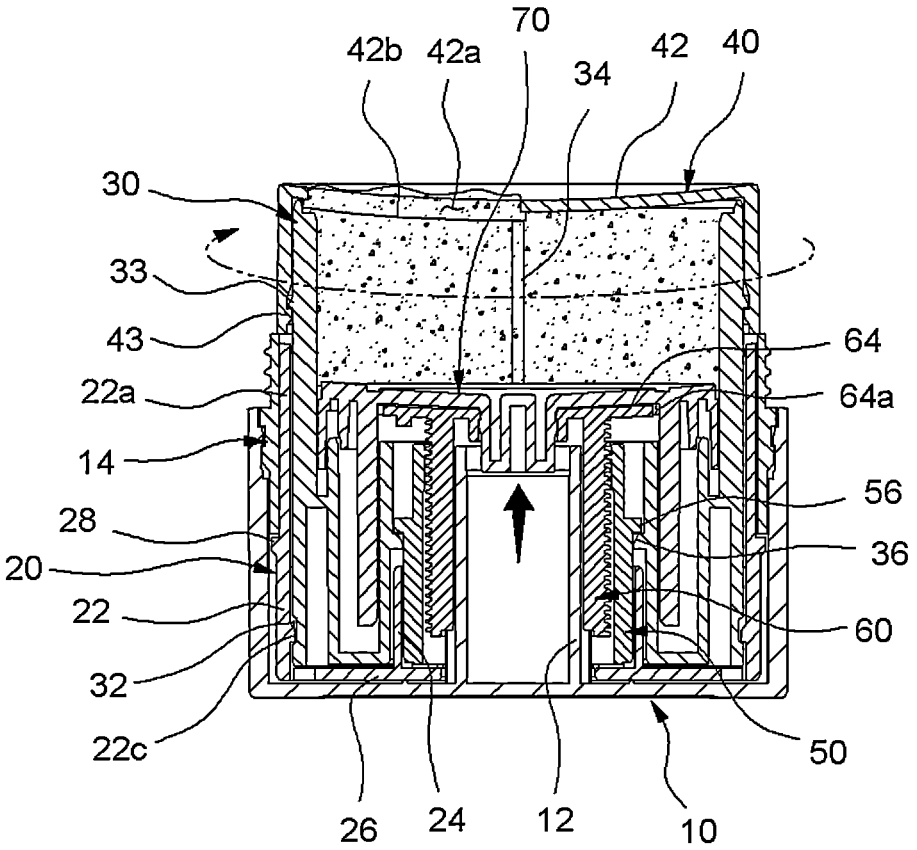
FIG. 5 is a sectional view illustrating rotating operation of the cosmetic container according to the one embodiment of the present disclosure.
Figure 6:
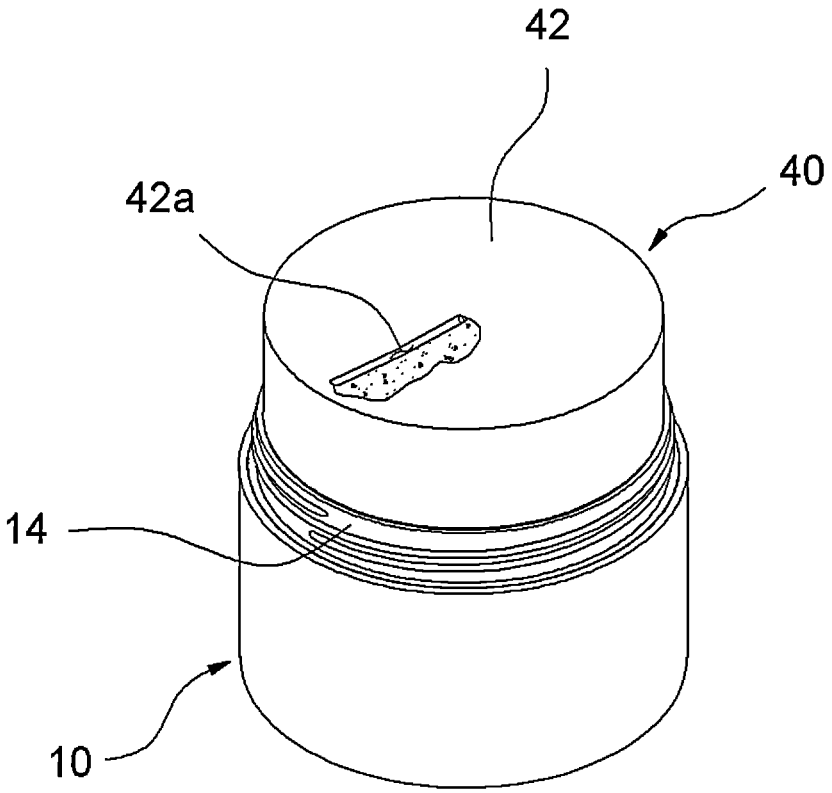
FIG. 6 is a sectional view illustrating a state in which the cosmetic container is operated to discharge cosmetic contents to the outside according to the one embodiment of the present disclosure.
Figure 7:
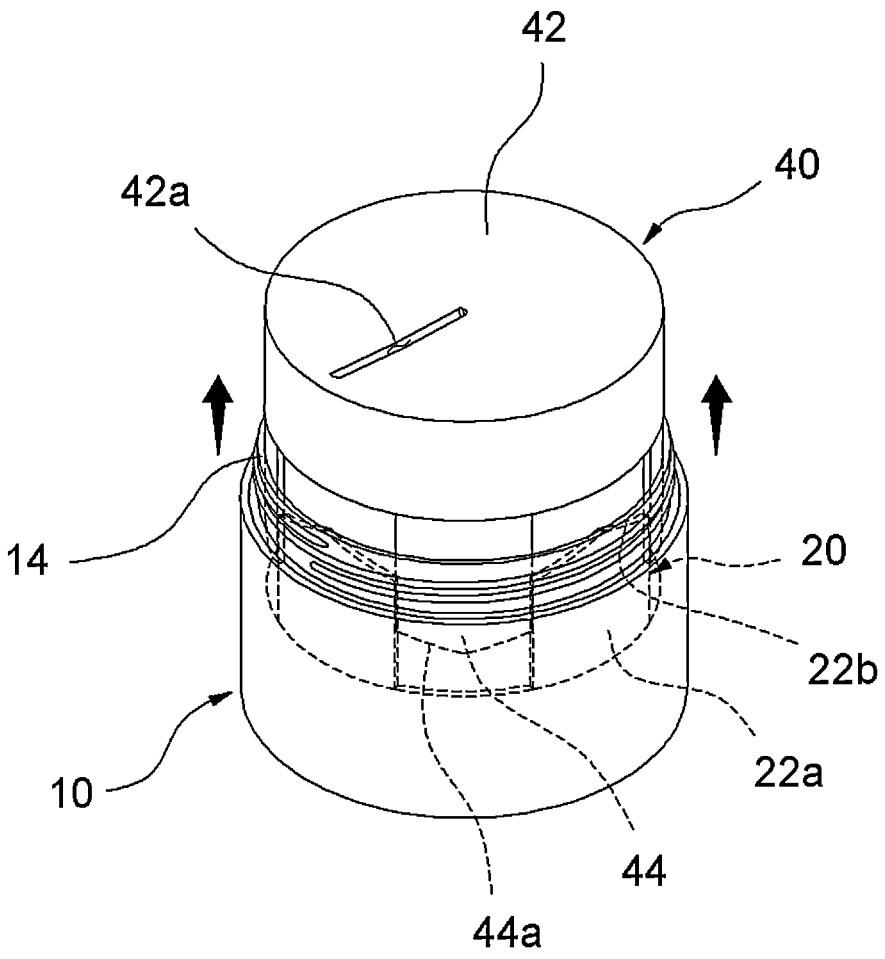
FIG. 7 is a perspective view illustrating a state in which an inner case of the cosmetic container is separated according to the one embodiment of the present disclosure.
Figure 8:
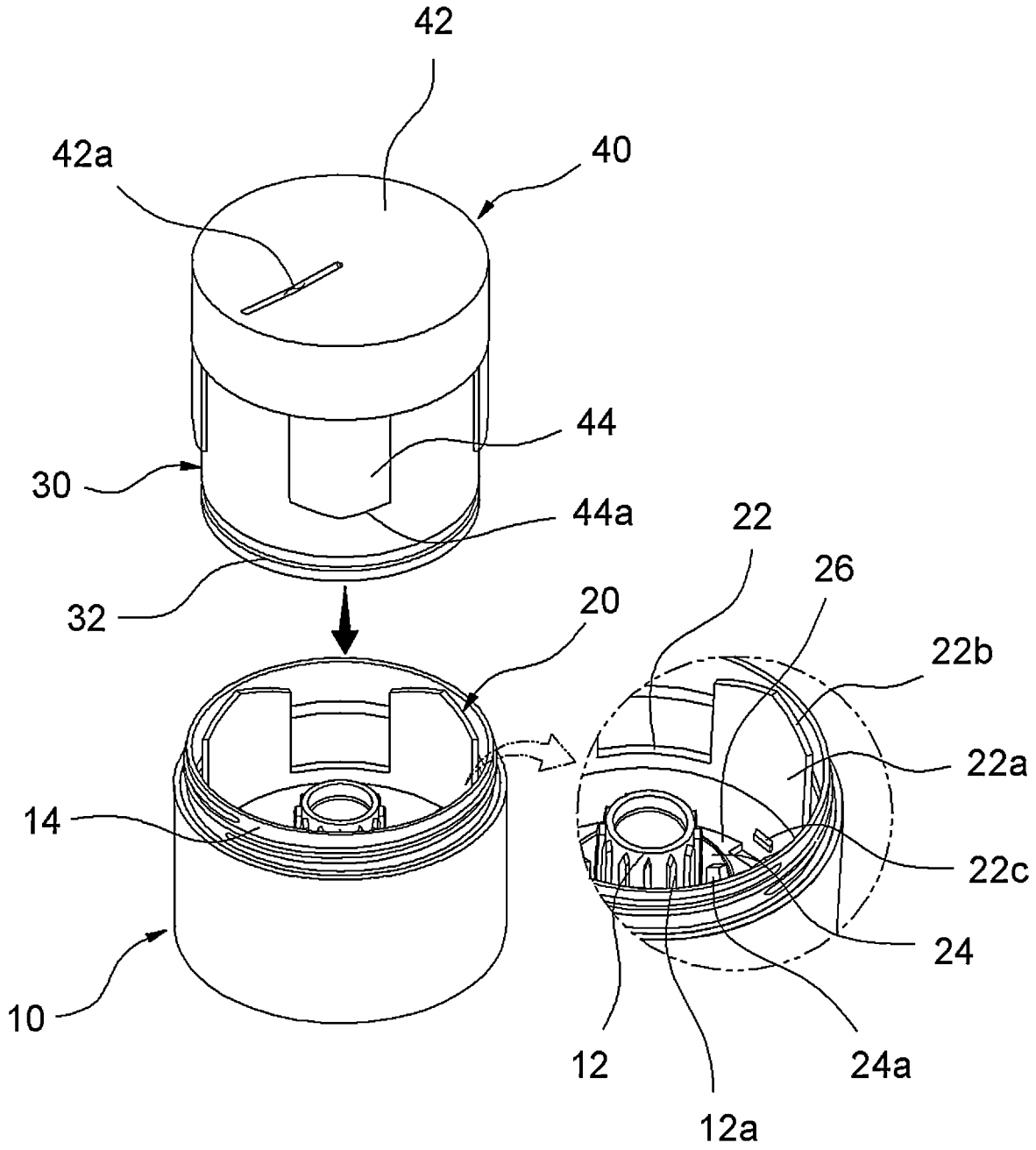
FIG. 8 is a perspective view illustrating a state in which the inner case of the cosmetic container is inserted according to the one embodiment of the present disclosure.

FIG. 5 is a sectional view illustrating rotating operation of the cosmetic container according to the one embodiment of the present disclosure. FIG. 6 is a sectional view illustrating a state in which the cosmetic container is operated to discharge cosmetic contents to the outside according to the one embodiment of the present disclosure. FIG. 7 is a perspective view illustrating a state in which the inner case of the cosmetic container is separated according to the one embodiment of the present disclosure. FIG. 8 is a perspective view illustrating a state in which the inner case of the cosmetic container is inserted according to the one embodiment of the present disclosure.

In order to use the rotating discharge type cosmetic container according to the embodiment of the present disclosure, the over-cap 80 is separated from the outer case 10 or the fixture 14 to expose the rotating member 40 to the outside.

Thereafter, as shown in FIG. 5 when the rotating member 40 is rotated in one direction with respect to the outer case 10, the rotation operating member 20 coupled to the rotating member 40 and the operating member 50 connected to the rotation operating member 20 are rotated together, while the rotation of the lifting member 60 is limited by the coupling extension portion 12 of the outer case 10. Accordingly, the lifting member 60 screw-coupled with the operating member 50 is gradually moved upward in proportion to the rotation section of the rotating member 40, and the piston 70 is raised by the lifting member 60, thereby pushing up the cosmetic contents toward the discharge port 42*a* of the rotating member 40.

Simultaneously, the cutting blade 42*b* of the rotating member 40 is rotated to cut an upper surface of the cosmetic contents, so that the cosmetic content cut by the cutting blade 42*b* is discharged through the discharge port 42*a* as shown in FIG. 6.

Thereafter, the cosmetic contents discharged through the discharge surface 42 of the rotating member 40 are dipped by using a cosmetic tool such as a puff (not shown), evenly applied onto the skin for makeup. After the makeup is completed, the rotating member 40 is covered with the over-cap 70 and coupled to the outer case 10 or fixture 14 for storage or carrying.

In addition, when the cosmetic contents contained in the inner case 30 are entirely used, the inner case 30 is replaced and used. As shown in FIG. 7, the rotating member 40 is pulled from the outer case 10, thereby separating the components coupled to the rotating member 40, that is, the inner case 30, the operating member 50, the lifting member 60, and the piston 70. At this timing, the first detachable portion 22*c* of the rotation operating member 20 is unfastened from the second detachable portion 32 of the inner case 30, the second rotation connecting portion 44 of the rotating member 40 is continuously separated from the first rotation connecting portion 22*a* of the rotation operating member 20, and simultaneously the second fixed connection portion 62*a* of the lifting member 60 is separated from the first fixed connection portion 12*a* of the outer case 10.

Thereafter, as shown in FIG. 8, the inner case 30, the operating member 50, the lifting member 60, and the piston 70 coupled to the rotating member 40 are completely separated from the outer case 10, and then a new rotating member 40 and inner case 30, the operating member 50, the lifting member 60 and the piston 70 coupled to the inner case 30 are inserted into the inner space of the outer case 10 for replacement. While the second rotation connecting portion 44 of the rotating member 40 is inserted between the first rotation connecting portions 22*a* of the rotation operating member 20, the second fixed connection portion 62*a* of the lifting member 60 is inserted between the first fixed connection portions 12*a* of the outer case 10, and the first detachable portion 22*c* of the rotation operating member 20 and the second detachable portion 32 of the inner case 30 are continuously coupled to each other.

One aspect of the present disclosure has been described with reference to limited embodiments, drawings, and particular items such as specific components, it may be understood that the above description has been merely provided for further understanding the present disclosure, and the present disclosure is not limited to the embodiments. It will be understood by those skilled in the art that various modifications and deformations may be carried out. Therefore, the idea of the present disclosure will not be determined by the aforementioned embodiments only, and the following claims as well as all modifications or variations belonging to the equivalents of the claims are within the scope of the present disclosure.

What is claimed is:

1. A rotating discharge type cosmetic container comprising:

an outer case formed therein with a first fixed connection portion;

a rotation operating member rotatably coupled to an inside of the outer case and formed therein with a first rotation connecting portion;

an inner case detachably coupled to the rotation operating member to accommodate cosmetic contents therein;

a rotating member rotatably coupled to the inner case, formed therein with a second rotation connecting portion, and having one surface formed with a discharge port;

an operating member connected to the rotation operating member and rotated together with the rotation operating member;

a lifting member screw-coupled with the operating member, moved in a straight line within the inner case, and formed therein with a second fixed connection portion; and a piston for moving the cosmetic contents while being moved up and down together with the lifting member.

2. The rotating discharge type cosmetic container of claim 1, wherein an over-cap for opening and closing the rotating member is detachably coupled to the outer case.

3. The rotating discharge type cosmetic container of claim 1, wherein the first fixed connection portion of the outer case and the second fixed connection portion of the lifting member extend in a detached direction of the inner case so as to be engaged with each other to limit rotation of the lifting member with respect to the outer case.

4. The rotating discharge type cosmetic container of claim 1, wherein the first fixed connection portion and the second fixed connection portion alternately protrude from facing surfaces between the outer case and the lifting member.

5. The rotating discharge type cosmetic container of claim 1, wherein the rotation operating member and the inner case are formed thereon with a first detachable portion and a second detachable portion, respectively, so as to be detachably coupled to each other.

6. The rotating discharge type cosmetic container of claim 1, wherein the first rotation connecting portion of the rotation operating member and the second rotation connecting portion of the rotating member extend in a detached direction of the inner case so as to be engaged with each other to transmit a rotation movement of the rotating member to the rotation operating member.

7. The rotating discharge type cosmetic container of claim 1, wherein the first rotation connecting portion and the second rotation connecting portion alternately extend by a predetermined section on facing ends between the rotation operating member and the rotating member.

8. The rotating discharge type cosmetic container of claim 1, wherein the first and second rotation connecting portions have ends formed thereon with first and second guide inclined surfaces, respectively.

9. The rotating discharge type cosmetic container of claim 1, wherein the rotating member is provided with a cutting blade for cutting a surface of the cosmetic contents.

10. The rotating discharge type cosmetic container of claim 1, wherein in a refilling process of fastening the inner case and the rotation operating member with each other, the first rotation connecting portion of the rotation operating member is engaged and fitted with the second rotation connecting portion of the rotating member, and simultaneously the first fixed connection portion of the outer case is engaged and fitted with the second fixed connection portion of the lifting member.

* * * * *